US005492306A

United States Patent [19]

Zaguroli, Jr.

[11] Patent Number: 5,492,306

[45] Date of Patent: Feb. 20, 1996

[54] AIR BALANCE HOIST WITH LOAD POSITION INDICATOR

[75] Inventor: James Zaguroli, Jr., Drayton Plains, Mich.

[73] Assignee: Knight Industries, Inc., Auburn Hills, Mich.

[21] Appl. No.: 215,317

[22] Filed: Mar. 21, 1994

[51] Int. Cl.[6] ..... B66D 1/48

[52] U.S. Cl. ..... 254/268; 254/360

[58] Field of Search ..... 254/268, 360, 254/361; 116/68, 281, 283; 200/47

[56] References Cited

U.S. PATENT DOCUMENTS

| | | | |
|---|---|---|---|
| 3,260,508 | 7/1966 | Powell | 254/360 X |
| 3,656,715 | 4/1972 | Powell | 254/360 X |
| 3,933,388 | 1/1976 | Conboy | 254/360 X |
| 3,960,362 | 6/1976 | Griffiths et al. | 254/360 X |
| 4,403,130 | 9/1983 | Baker | 116/283 X |
| 5,370,367 | 12/1994 | Zaguroli, Jr. | 254/360 |

*Primary Examiner*—Daniel P. Stodola
*Assistant Examiner*—Emmanuel M. Marcelo
*Attorney, Agent, or Firm*—John R. Benefiel

[57] ABSTRACT

An air balancing hoist having one or more activators providing a signal when a load reaches one or more predetermined heights. The activators each comprise spring loaded plungers mounted to be shifted from an axial location by movement of the drum spool to a predetermined axial location.

8 Claims, 2 Drawing Sheets

AIR BALANCE HOIST WITH LOAD POSITION INDICATOR

BACKGROUND OF THE INVENTION

This invention concerns air balancing hoists in which a load supporting cable or chain is wound on a drum which is configured as a spool fixed to a ball nut received on a ball screw. The spool is axially engaged with a piston controllably subjected to air pressure to be axially advanced on the ball screw. This causes the spool to be rotatably held, advanced, or released to support, raise or lower a load connected to the cable (or chain).

It would sometimes be desirable to generate a signal corresponding to the position of a supported load, such as to prevent release when the load is raised.

Such devices are typically used in industrial production environments, which are automated to increasing degrees, and load position signals could be used as a part of an automated system.

For example, when transporting the hoist by a trolley moved along an overhead rail, the load may need to be raised to a predetermined height to clear an obstruction prior to being driven to another location. Load position signal generating devices have not been heretofore provided for air balancing hoists.

It is thus an object of the present invention to provide an air balancing hoist incorporating a load position signal generating device.

SUMMARY OF THE INVENTION

These and other objects of the present invention are accomplished by an air balancing hoist having one or more plunger assemblies, each plunger assembly including a housing tube mounted extending axially into one end of the hoist housing. A plunger rod is slidable within the housing tube and has one end which protrudes to be engageable with the end of drum spool opposite the drum spool end axially engaged by the air piston.

The plunger is spring urged towards the drum spool end and has a stop which abuts an adjustable collar clamped to the housing tube. The stop extends radially outward and has a face which is engaged by a switch button.

When the drum spool advances axially to a predetermined position, its one end engages the plunger and pushes the same away from its adjusted stop position.

The release of the switch button and consequently the change of state of the switch contacts enables an electric signal to be generated when the load reaches the position corresponding to the drum spool position whereat it contacts the plunger rod one end.

That position may be adjusted by the shifting of the clamping collar on the housing tube.

A series of plunger assemblies may be employed, each having different stop positions of the respective plunger rods to enable a plurality of different load height signals to be generated.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
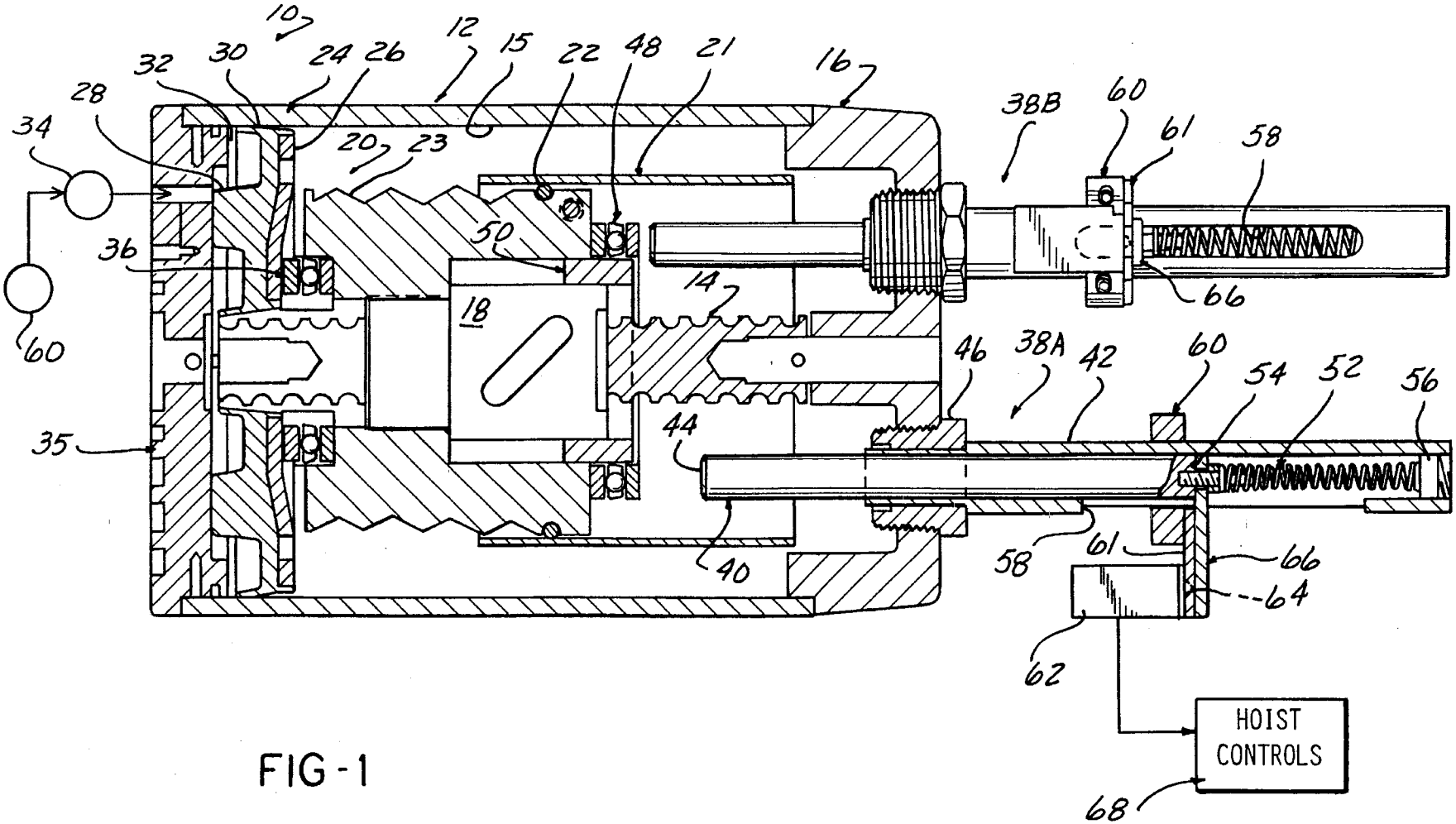
FIG. 1 is a partially sectional view of an air balancing hoist having load position indicator devices installed thereon.
Figure 2:
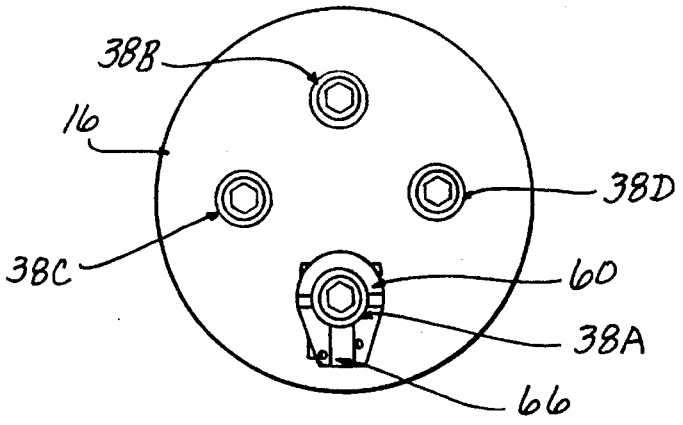
FIG. 2 is an end view of the air balancing hoist shown in FIG. 1.

Referring to FIG. 1, the air balancing hoist 10 includes a generally cylindrical housing 12 supported so as to be prevented from rotating, typically by an attached trolley shoe running along an overhead rail as described in U.S. Pat. No. 3,260,508.

A ball screw 14 is fixed at one end to the right cover 16 of the housing 12, projecting to the left across the interior bore 15 in the housing 12.

A recirculating ball nut 18 is received over the ball screw 14 fixed within a drum spool 20.

The drum spool 20 has a cable 22 attached at one end to be wound into a helical groove 23 formed into the exterior of the drum reel 20 as it is rotated by the ball nut 18.

An axially movable element, here comprised of a piston 24, is slidably received in the interior bore 15 of the housing 10, piston 24 comprised of a metal disc 26 having a molded urethane plastic sealing part 28 bonded thereto. Sealing part 28 has a skirt portion 30 which sealingly engages the inside of the housing 12 to define a pressure chamber 32 to the left of piston 24 and the right of end cap 35, which chamber 32 is pressurized by a source of regulated air pressure 34.

The piston 24 drives the left end of the drum spool 20 by engagement with an interposed thrust bearing 36.

A cable confinement sleeve 21 is fixed to the end cap 16 and receives the drum spool 20 as it moves to the left in winding the cable 22, maintaining the cable 22 in the groove 23.

Thus, the weight of a load acting on the cable 22 tends to cause the nut 18 to rotate, reacting on the stationary ball screw 14 to drive the nut 18 and drum spool 20 to the left. This tendency is countered by the force generated on the piston 24 by regulated air pressure in chamber 32.

As described in the above referenced patent, the regulated air pressure can be set to just balance the load, or to allow only a few pounds of the weight to be unbalanced, or to drive the piston 24 to raise the load with a controller valve device, in the manner well known in the art.

A thrust bearing 48 is seated against the opposite end of the drum spool 20 from that end driven axially by the air piston 24, located concentrically with a centering collar 50 pressed onto the ball nut 18.

According to the present invention one or more plunger rod assemblies 38A–38D are mounted in the end cap 16. Each plunger assembly includes an elongated element comprised of a plunger rod 40 slidable within a housing tube 42, one end 44 projecting axially towards the thrust bearing 48. The housing tube 42 is secured within the end cap 16 by a split clamping bushing 46 formed with an external pipe thread to clamp the housing tube 42 to the end cap 16.

The plunger rod 40 is yieldably urged to be pushed out of the housing tube 42 and towards the drum spool 20 by a spring 52 compressed to act on the other plunger rod end 54 opposite the one end 44 of the plunger rod 40, a cap 56 closing off the housing tube 42 to compress the spring 52.

The other plunger rod end 54 has a stop plate 66 affixed thereto which projects radially out through a slot 58 in the housing tube 42. The stop plate 66 abuts a stop ring 60 clamped to the outside of the housing tube 42 to limit the axial movement of the plunger rod 40 under the influence of the spring 52. The axial location of the stop ring 60 determines the location of the end face 44 of the plunger rod 40 at which it is held by the spring 52 and thus its axial spacing from the thrust bearing 48 prior to contact with the thrust bearing 48.

A micro switch 62 is mounted to the stop ring 60 by an intermediate holder plate 61 fixed to the stop ring 60 and switch 62, having a switch button 64 located to be depressed by the stop plate 66 when the stop plate 66 is abutted against the stop ring 60.

Depression of the switch button 64 causes switch contacts to be opened (or closed) and reverse the contact condition, so that a signal may be generated when the plunger rod 40 is moved to the stop position shown and also when the drum spool 20 engages the rod end 44 and moves it away from the stop ring 60.

By substituting a valve for switch 62, an air signal can also be generated.

The plunger rod assembly 38 thus comprises switch activator means for this purpose.

The signals generated by closing or opening of the switch contacts as the drum spool moves through its range of movement to engage or disengage the rod end provide an indication of the position of the load in the range of motion lying on either respective side of the location whereat the contacts are opened and closed.

These signals can be appropriately utilized in the hoist controls 68.

Each plunger rod assembly 38A–38D can have a different setting to generate signals corresponding to a number of positions of the drum spool 20 and the corresponding load positions.

Figure 3:
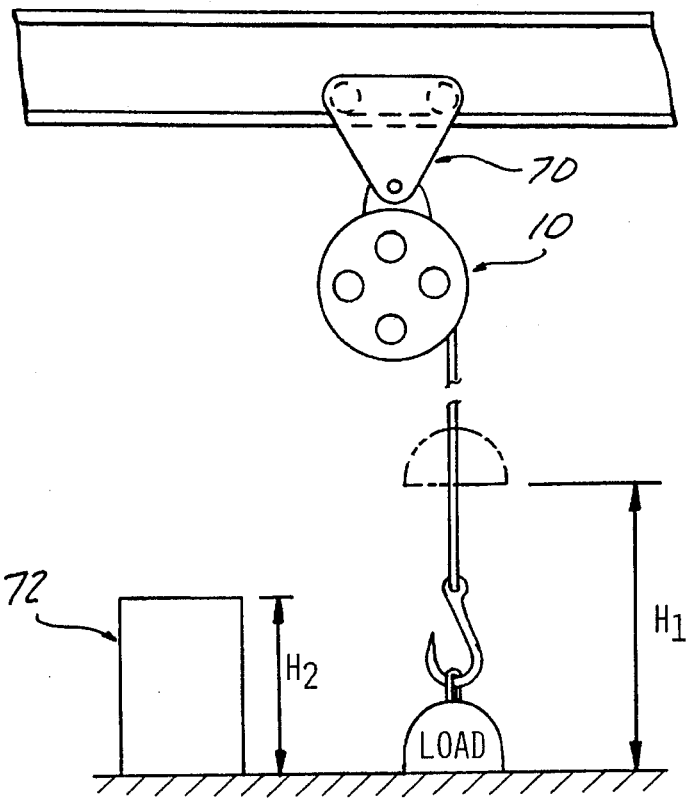
FIG. 3 is a diagrammatic representation of an air balancing hoist and associated trolley and supported load depicting the load heights which may typically be significant.

FIG. 3 shows two typical load positions of interest. Whenever the load is raised to a height $H_1$, a safety interlock can be established preventing release of the air pressure until the load has again been lowered the height $H_1$ to reopen switch contacts.

This can be accomplished with an interlock in the hoist controls preventing release of pressure until the load has been lowered to open (or close) the switch contacts of the switch 62.

Another situation may arise where the hoist 10 is prevented from advancing on the trolley 70 until being raised sufficiently to clear an obstruction 72, i.e. to height $H_2$. The plunger rod 40 is adjusted to be engaged only after the load has been raised to at least the height $H_2$.

I claim:

1. An air balancing hoist comprising:

a housing having an interior bore therein;

a ball screw mounted in said housing to extend axially through said interior bore;

a ball nut received over said ball screw;

a drum spool fixed to one of said ball nut and ball screw to move axially therewith through a range of motion, the other of said ball screw and ball nut fixed to said housing;

a cable attached to said drum spool so as to be wound thereon and unwound therefrom upon rotation of said drum reel in either axial direction;

a movable element axially movable in said housing interior bore and sealed therein to define a pressure chamber on one side thereof, the other side drivingly engaging one end of said drum spool to create an axial force thereon when said chamber is pressurized;

a source of regulated air pressure in communication with said chamber applying a pressure level sufficient to at least substantially balance an axial force exerted by said cable supporting a load acting through said ball screw and nut to generate an axial force on said drum spool acting oppositely to said axial force generated by said regulated air pressure acting in said chamber;

an element mounted to said housing to be movable therein, said element having a portion located opposite one end of said drum spool;

means yieldably urging said element against a relatively fixed stop, said element portion located so as to be engaged by said one end of said drum spool at a predetermined point in moving through said range of axial movement thereof and disengaged upon return movement thereof past said predetermined point; and, signal generating means changing states in response to said one end of said drum spool engaging said portion of said element by movement of said drum spool past said predetermined point in said range of axial movement to move said element away from said fixed stop against the force exerted by said means yieldably urging said element against said fixed stop, or to allow said force to again position said element against said fixed stop, said change of state indicating a load height position in a range corresponding to said drum spool axial location whereat said element is engaged and disengaged.

2. The air balancing hoist according to claim 1 wherein said element is included in a plunger assembly mounted to said housing, said element comprising a plunger rod having one end comprising said element portion projecting axially towards said drum spool one end, said plunger rod yieldably positioned at an axial location by said means yieldably urging said plunger rod towards said drum spool and against said fixed stop, said signal generating means changing state when one end of said plunger rod is shifted from said axial location by engagement and movement of said drum spool, and when shifted back to said location by disengagement by return movement of said drum spool.

3. The air balancing hoist according to claim 2 wherein said plunger assembly includes a housing tube slidably receiving said plunger rod, said housing tube mounted to said housing.

4. The air balancing hoist according to claim 3 wherein said means yieldably urging said plunger rod one end towards said drum spool one end comprises a compression spring in said housing tube engaging the other end of said plunger rod so that said plunger rod one end is yieldably urged against said fixed stop.

5. The air balancing hoist according to claim 3 wherein said plunger rod has a radially extending stop plate affixed thereto, said housing tube has an axially extending slot through which said stop plate projects, and further including a stop adjustably mounted to said housing tube to be engaged by said stop plate when said plunger rod is at said axial location.

6. The air balancing hoist according to claim 5 wherein said signal generating means includes an electrical switch supported by said adjustable stop having a button element engageable by said stop plate.

7. The air balancing hoist according to claim 5 wherein said stop comprises a stop ring clamped to said housing tube.

8. The air balancing hoist according to claim 1 further including a plurality of signal generating means and associated elements movably mounted in said housing, each having a portion engaged by said drum spool after a predetermined extent of movement of said drum spool to successive axial locations in said housing, each changing state when engaged by said one end of said drum spool, whereby a plurality of signals each corresponding to a respective different load height range position is generated.

* * * * *